United States Patent [19]

Ewing

[11] Patent Number: 4,540,112

[45] Date of Patent: Sep. 10, 1985

[54] VINE STAPLER

[76] Inventor: Ed Ewing, 1360 Bennett La., Calistoga, Calif. 94515

[21] Appl. No.: 535,425

[22] Filed: Sep. 26, 1983

[51] Int. Cl.[3] ..... B25C 1/02; B25C 5/00; B25C 5/11

[52] U.S. Cl. ..... 227/152; 227/144; 227/151; 227/154; 227/156

[58] Field of Search ..... 227/144, 147, 151, 152, 227/154, 156; 7/117; 254/131

[56] References Cited

U.S. PATENT DOCUMENTS

| | | | |
|---|---|---|---|
| 148,552 | 3/1874 | Davis | 227/151 |
| 305,897 | 9/1884 | Cox | 254/131 |
| 684,426 | 10/1901 | Harvey et al. | 254/131 |
| 1,265,842 | 5/1918 | Walker | 227/144 |
| 1,479,512 | 1/1924 | Perkins | 227/144 X |
| 1,911,036 | 5/1933 | Phenix | 227/144 |
| 4,183,503 | 1/1980 | Ward | 254/131 |

FOREIGN PATENT DOCUMENTS

| | | | |
|---|---|---|---|
| 804426 | 4/1951 | Fed. Rep. of Germany | 254/131 |
| 828909 | 1/1952 | Fed. Rep. of Germany | 254/131 |
| 1029919 | 6/1953 | France | 254/131 |
| 1292409 | 3/1962 | France | 254/131 |

*Primary Examiner*—Paul A. Bell

*Attorney, Agent, or Firm*—Andrew A. Steiner; David Ripma

[57] ABSTRACT

The invention discloses a tool for securing wire to grapevines by staples. The tool comprises a long handle pivotally mounted to a plate, the plate is bent at a 90 degree angle, one of the plate's side faces the handle. The handle has two circular depressions for holding the staples.

5 Claims, 4 Drawing Figures

19
3
7
17
9
1

3
1
21

3
11
5
5
13
13

11
3
1

VINE STAPLER

BACKGROUND AND SUMMARY

In a vineyard wires are pulled out and secured to the stakes by staples providing support for the grape vines. The method presently employed is to drive the staples into the stakes by a hammer. The hammering is time consuming and hard on the hand of the operator as he has to hold the stake with one hand during the hammering of the staple. The instant invention provides a tool which makes the driving in of the staples quicker and is easier on the operator. The stapler comprises a plate bent into a 90 degree angle, and a long handle. One side of the plate is opposite to the handle, the handle is pivotally mounted on the plate and is provided with depressions for holding the staple.

In operation, the plate is held against the stake, the side facing the handle positioned against the stake opposite to the wire to be secured and the handle holding the staple is pushed forwardly for driving in the staple.

DETAILED DESCRIPTION

Figures 1, 2, 3, 4:
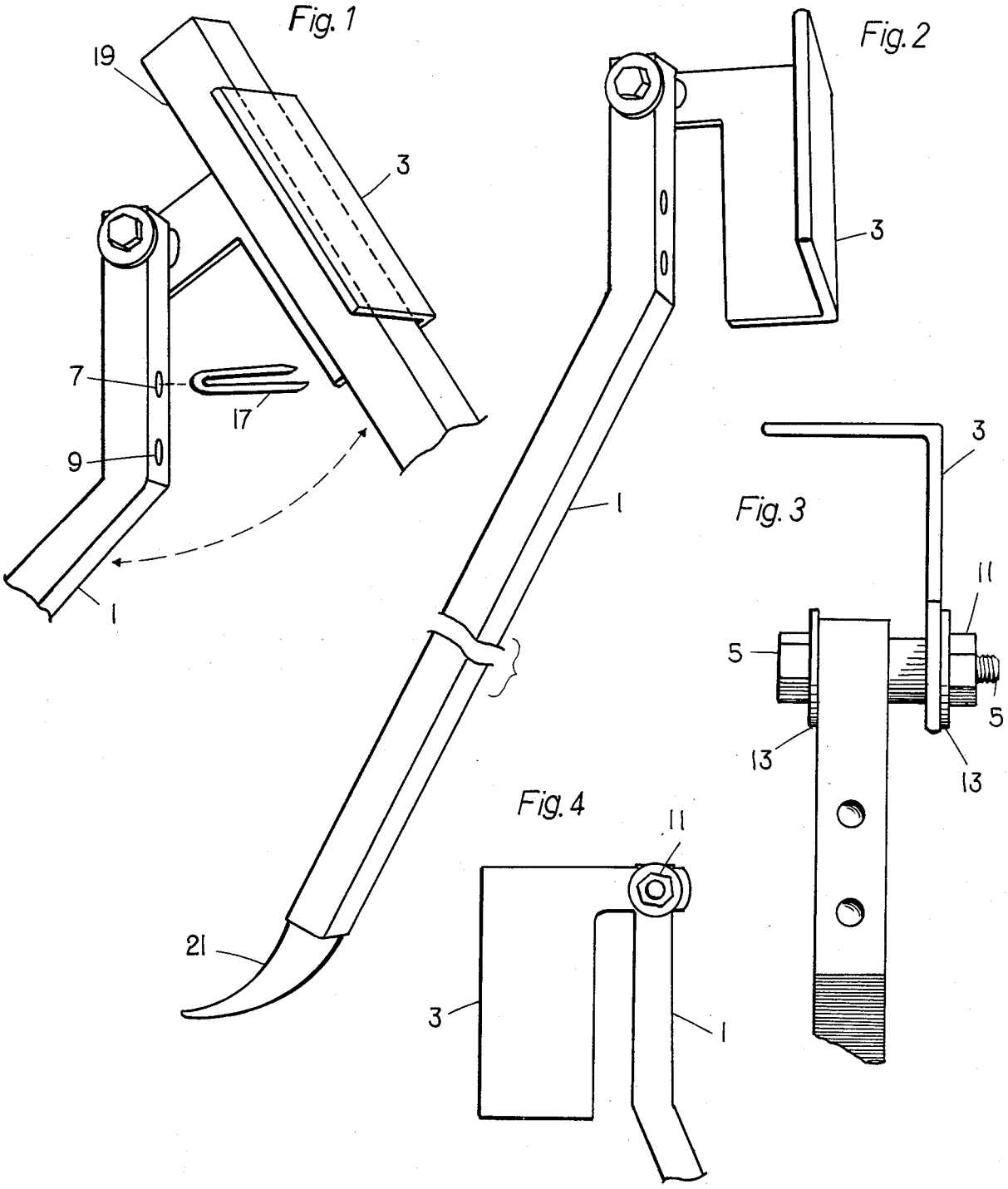
FIG. 1 is an elevated view of the tool showing the tool placed against a stake.
FIG. 2 is an elevated view of the tool.
FIG. 3 is a plain view of the tool showing the details of the mounting of the handle to the plate.
FIG. 4 is a plain view of the tool showing the back plate and part of the handle.

Referring now to the drawings the tool comprises a plate 3 bent into a rectangular shape, one side of the plate has a narrow extension on which a handle 1 is pivotally mounted, the other side of the plate 3 is facing the movement of the handle 1. The handle on its top portion facing the plate has two circular depressions 7 and 9 for positioning the staples. The bottom of the handle terminates in a narrow point 21 suitable for removing the staples from the stake. The side of the plate 3 on which the handle is mounted optionally has a cylinder welded to it for carrying the pivotal mounting of the handle. In operation, the plate is placed around the stake, the wire to be secured on the stake is placed and the forward motion of the handle forces the staple placed into the circular depression into the stake.

I claim:

1. A tool for driving staples into a stake consisting essentially of: a plate bent into a rectangular shape, a handle pivotally mounted on said plate, said plate including a side facing said handle and said handle including a top portion facing said plate, said plate being adapted to be placed around and held against a stake when driving a staple into the stake such that said top portion of said handle facing said plate forces a staple into the stake when said handle is moved forwardly and said plate being bent to a ninety degree angle, one side of said plate including an extension on which said handle is pivotally mounted, the other side of said plate being said side facing said handle.

2. A tool as described in claim 1 where the top portion of the handle facing the plate has two circular depressions.

3. A tool as described in claim 1 where the bottom portion of the handle terminates in a point.

4. A tool as in claim 1 in which said top portion of said handle facing said plate for forcing staples into a stake includes a depression in which the staple is positioned for driving into the stake.

5. A tool as in claim 4 in which said handle includes a bottom portion which terminates in a point for removing staples from a stake.

* * * * *